United States Patent [19]

Blazejewski

[11] 4,430,050

[45] Feb. 7, 1984

[54] ROTARY, POSITIVE-DISPLACEMENT MACHINE

[75] Inventor: Theodore E. Blazejewski, Corning, N.Y.

[73] Assignee: Ingersoll-Rand Company, Woodcliff Lake, N.J.

[21] Appl. No.: 342,122

[22] Filed: Jan. 25, 1982

[51] Int. Cl.[3] ..... F01C 1/24; F04C 18/00

[52] U.S. Cl. ..... 418/191

[58] Field of Search ..... 418/150, 191, 9

[56] References Cited

U.S. PATENT DOCUMENTS

| | | | |
|---|---|---|---|
| Re. 29,627 | 5/1978 | Weatherston | 418/191 |
| 3,472,445 | 10/1969 | Brown | 418/191 |
| 3,989,413 | 11/1976 | McGahan | 418/191 |
| 4,059,368 | 11/1977 | McGahan | 418/9 |
| 4,224,016 | 9/1980 | Brown | 418/191 |

FOREIGN PATENT DOCUMENTS

| | | | |
|---|---|---|---|
| 9916 | 4/1980 | European Pat. Off. | 418/191 |
| 2073324 | 10/1981 | United Kingdom | 418/191 |

*Primary Examiner*—Leonard E. Smith
*Assistant Examiner*—Jane E. Obee
*Attorney, Agent, or Firm*—B. J. Murphy

[57] ABSTRACT

The machine comprises a housing with parallel intersecting bores in which two pair of lobed rotors are rotatably mounted. The housing has high-pressure, end ports which are occluded and exposed by one rotor, i.e., a gating rotor, of each rotor pair. The gating rotors and their paired, co-acting rotors, i.e., main rotors, have different-sized hubs. The gating rotors have the larger-diameter hubs to control the high-pressure end ports. The rotor pairs are so configured and dimensioned as to insure that each pair defines a constant and uniform clearance therebetween in all rotary positions, and provide a machine having an optimum performance.

28 Claims, 5 Drawing Figures

ROTARY, POSITIVE-DISPLACEMENT MACHINE

This invention pertains to rotary, positive-displacement machines and, in particular, to machines of that type which have interengaging lobed-roters adapted to handle a fluid. Such machines comprise gas compressors, expanders, pumps, and the like, and are fairly well known in the prior art particularly from U.S. Pat. No. 3,472,445 issued on Oct. 14, 1969 to Authur E. Brown, for a "Rotary Positive Displacement Machine", and U.S. Pat. No. 4,224,016, issued Sept. 23, 1980, again to Authur E. Brown, for "Rotary Positive Displacement Machines".

In U.S. Pat. No. 3,472,445, patentee Brown sets forth an early teaching of the benefit of having the hub of the gating rotor, in rotary, positive-displacement machines, larger than the hub of the interengaging main rotor. This is so that the high-pressure fluid ports, which are controlled by the gating rotor, can be made larger to prevent unwarranted throttling when the machine is run at high speed. Also, in U.S. Pat. No. 4,224,016 Brown taught the forming of the lobes on the gating rotor with a smaller angle than those on the main rotor. This, so as to limit precompression losses, as well as throttling losses. It remained, however, for someone to define the metes and bounds for the specific geometries of the rotors whereby a most efficient machine, with the aforesaid features, can be constructed.

It is an object of this invention to set forth the prescribed geometries and rather specific definitions of the co-acting rotors.

it is also an object of this invention to set forth a rotary, positive-displacement machine, with interengaging lobed-rotors having different-sized lobes, adapted to handle a fluid, comprising a housing; said housing having a pair of parallel, cylindrical, intersecting bores, end walls for said bores, and first and second ports for the conduct therethrough of high-pressure and low-pressure fluid, respectively; wherein said first port is formed in one of said end walls; and first and second lobed rotors rotatably mounted in said bores; wherein said first rotor has a hub which occludes said first port; and said hub has a radius of not more than ninety percent of the radius of the bore in which said first rotor is mounted.

Further objects of this invention, as well as the novel features thereof, will become more apparent by reference to the following description taken in conjunction with the accompanying figures, in which.

Figure 1:
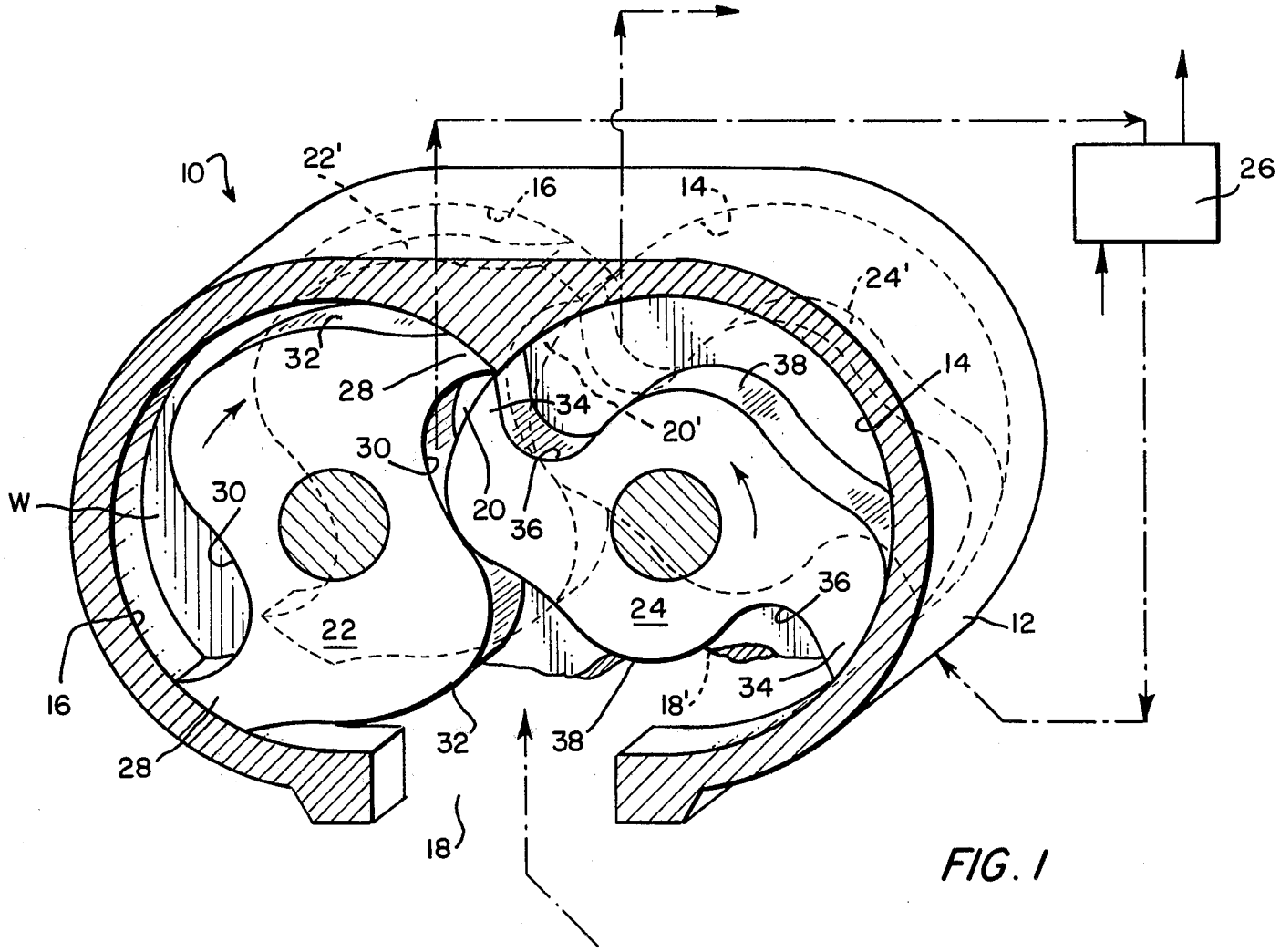
FIG. 1 is a partial pictorial view, in perspective, and a partial line drawing, of an embodiment of the invention.

As shown in the figures, a rotary, positive-displacement machine 10 has a housing 12 in which are formed a pair of parallel, cylindrical and intersecting bores 14 and 16. The housing 12 has an inlet port or low-pressure port 18 and ports 20 in end walls "W" (only part of one is shown) of the bores to accommodate high-pressure fluid therethrough. A first rotor 22, is rotatably mounted in bore 16 and, during rotation, closes off and exposes the high-pressure ports 20. Rotor 22 coacts with a second, main rotor 24, rotatably mounted in bore 14, to move fluid through the ports. Only by way of example the invention will be described in connection with the machine 10 used as a gas compressor in which the first, gating rotor 22 rotatates in a clockwise direction and the main rotor 24 in a counterclockwise direction. Too, port 18, then, is an inlet port and ports 20 are outlet or discharge ports.

The machine 10, being a gas compressor, has first and second stages, and the foremost portion of housing 12 (in FIG. 1) comprises the first stage, having the rotors 22 and 24. In the preferred embodiment depicted, the second stage, shown only in phantom, is defined within the same housing 12, in axial alignment with the first stage. The bores 14 and 16 are common to both stages, however the housing has an intervening wall therebetween (not fully shown) to close off the stages from communication. Such an arrangement is shown in U.S. Pat. No. 4,090,588, issued May 23, 1978, to Larry N. Willover, for "Means for Lubricating Machine Components". FIG. 1 is drawn to clarify the interstage compressed-gas flow in which the compressed gas product of the first stage exits via ports 20 and proceeds to an interstage cooler 26 and, upon being cooled, enters the second stage inlet 18'. The second stage, of course, has complementary first and second rotors 22' and 24' of generally the same configurations as rotors 22 and 24 (of the first stage) albeit of differing dimensions. The novel configurations of the first and second stage rotors are set forth in the ensuring text.

First-stage gating rotor 22 has a pair of oppositely-disposed lobes 28, and grooves 30, which interrupt the hub 32 thereof. Similarly, the main rotor 24 has lobes 34, grooves 36, and a hub 38.

As already noted, it is now known to have the hub 32 of the gating rotor 22 larger than the hub 38 of the main rotor 24, in order that the exhaust ports 20 may be as large as possible, but there is some practical limit to which the gating rotor hub enlargement may go. It is a teaching of this invention that the hub 32 should have a radius of not more than ninety percent of the radius of the bore 16 in which the gating rotor 22 is mounted. Also, the radius of hub 32 should not be less than eighty-five percent of the bore 16 radius. In the embodiment shown, the radius of hub 32 is eighty-eight and three-tenths (88.3) percent of the radius of bore 16. Working from computer analyses, and after making painstaking calculations, I have determined that this is an optimum definition; it provides for as large a port 20 as possible, without unduly (a) restricting the volume of the bore 16 and (b) causing excessive throttling when the closing fluids in both bores 14 and 16 join (during early compression). The hub 38 of the co-acting, main rotor 24, also should not have a radius of more than sixty-five percent of the radius of the bore 14; neither should its radius be less than sixty percent of the bore 14 radius. Particularly, the aforesaid analyses and calculations prescribe that the radius of hub 38 should be sixty-three and four-tenths (63.4) percent of the radius of bore 14.

To define optimum fluid volumes in the bores 14 and 16 of the first stage (and the second stage), and to insure efficient machine performance through definitive rotor profiles and interengaging surfaces, the rotor configurations and relative proportions of each are comprised by the invention. As to these, the lobes 28 of the first stage gating rotor 22 each occupy approximately thirty degrees of angle about the circumference of the rotor. The hub 32 occupies a little less than approximately one hundred and sixty degrees of the rotor circumference, and the grooves 30 on each side occupy angles of a little more than approximately eighty degrees. These large grooves 30 expose the exhaust ports 20, of the first stage, for an extended period of time, to allow the compressed gas product to evacuate without undue throttling, and the relatively wide-angle hubs 32 and lobes 28 occlude the ports 20 long enough to allow the fluid pressure to come to an acceptable discharge value.

The first stage second or main rotor 24 has wider lobes 34, the same occupying a little more than approximately seventy degrees of the circumference of the rotor, whereas the hub 38 has, on each side of the rotor, a like angular extent, i.e., a little less than approximately eighty degrees of arc, as has the hub 32 of the gating rotor 22. The grooves 36 are approximately one-half the width of the gating rotor grooves 30, as they have to accommodate only narrow angled lobes 28. The wide-angle lobes 34 on the main rotor 24 insure that there will be adequate sealing about the periphery during the compression cycle. The wider grooves 30 in the gating rotor, as noted, provide an extended gas discharge period, and must receive the wide-angle lobes 34 of the main rotor 24.

The rotors 22' and 24' of the second stage, while of like configurations, require differing dimensions than rotors 22 and 24 of the first stage. With respect to gating rotor 22', again it is a teaching of this invention that the hub 32' thereof should have a radius of not more than ninety percent of the radius of the bore 16 in which it is mounted, neither should it have a radius of less than eighty-five percent thereof. In the embodiment shown, hub 32' has a radius of eighty-seven and a half (87.5) percent of the radius of bore 16. The hub 38' of the co-acting, main rotor 24' also should have a radius of approximately seventy-five percent of the radius of the bore 14, and not less than seventy percent. My analyses and calculations prescribe that the radius of hub 38', in the embodiment shown, shall be seventy-five and one-tenth (75.1) percent of the radius of bore 14.

The lobes 28' of the second stage gating rotor 22' each occupy approximately thirty degrees of arc, and the hub 32' thereof occupies almost a full one hundred and eighty degrees of arc. The grooves 30' on opposite sides occupy angles of a little less than seventy degrees.

Again, the second stage main or second rotor 24' has wider lobes 34' than those of the gating rotor 22'. Lobes 34' occupy a little more than sixty degrees of arc. The hub 38' of the main rotor 24', on each side of the rotor, has an angular extent of amost a full ninety degrees. The groove 36', like grooves 36', are approximately one-half the width of the gating rotor grooves 30'.

Excepting the aforesaid critical, distinguishing dimensions, both first and second stage gating rotors 22 and 22', and both stage main rotors 24 and 24' are configured and developed alike. Such configurations and developments are set forth in the ensuing text.

The narrow angled lobes 28 and 28' on gating rotors 22 and 22' each have leading and intermediate reference points 40 and 42 respectively. A reference line 46 drawn from the axial center 48 of rotor 22 (or 22') through the intermediate reference point 42 traverses a second reference point 50. The convexity of flank 44 is defined by arc 52 drawn from point 50. A reference line 56 drawn from the axial center 48 of rotor 22 (or 22') through the leading point 58 of hub 32 traverses another, third reference point 60. The concavity of flank 54 is defined by arc 62, drawn from point 60, tangent to arc 52 at reference point 64.

The narrow angled grooves 36 and 36' on main rotors 24 and 24' each have a surface 70 defined with an abrupt trailing convexity, and an extended leading concavity having trailing and leading points 66 and 68 respectively, and a second, short convexity having trailing and leading points 68 and 72, respectively. The aforesaid convexity and concavity of surface 70 is generated by flank 54 and flank 44 on rotor 22 (or 22'), albeit incorporating a constant and uniform clearance therebetween while generating. Concave surface 74 on lobe 34 (or 34') of rotor 24 (or 24'), defined by radially aligned points 72 and 76, is generated by point 40 on rotor 22 (or 22') as point 40 sweeps out the concavity 74, again, while incorporating a constant and uniform clearance.

The wide angled lobes 34 and 34' on main rotors 24 and 24' each have trailing and intermediate reference points 76 and 78 respectively. A reference line 82 drawn from the axial center 84 of rotor 24 (or 24') through the intermediate reference point 78 traverses a second reference point 86. The convexity of flank 80 is defined by arc 88 drawn from point 86. A reference line 92 drawn from the axial center 84 of rotor 24 (or 24') through the trailing point 94 of hub 38 (or 38') traverses another, third reference point 96. The concavity of flank 90 is defined by arc 98, drawn from point 96, tangent to arc 88 at reference point 100.

The wide angled grooves 30 and 30' on gating rotors 22 and 22' each have a surface 106 defined with a leading convexity, and a trailing concavity having leading and trailing points 102 and 104 respectively, and a second convexity having leading and trailing points 104 and 108, respectively. The aforesaid convexity and concavity of surface 106 is generated by flank 90 and flank 80 on rotor 24 (or 24'), albeit incorporating a constant and uniform clearance therebetween while generating. Concave surface 110 on lobe 28 (or 28') of rotor 22 (or 22'), defined by radially aligned points 108 and 40, is generated by point 76 on rotor 24 as point 76 sweeps out the concavity 110, again, while incorporating a constant and uniform clearance.

Figure 2:
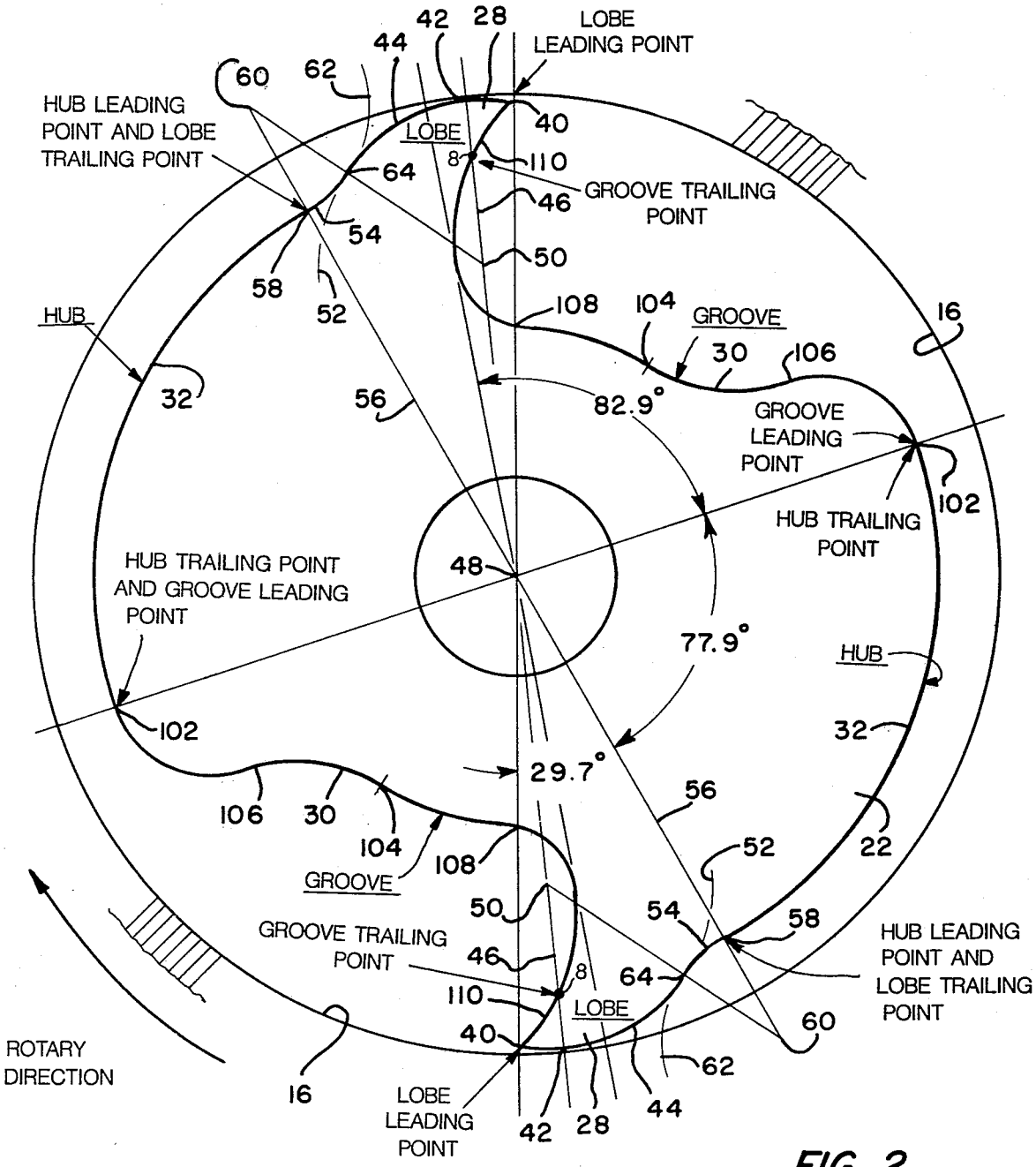
FIG. 2 is a line drawing of the gating rotor of the first stage of FIG. 1.
Figure 3:
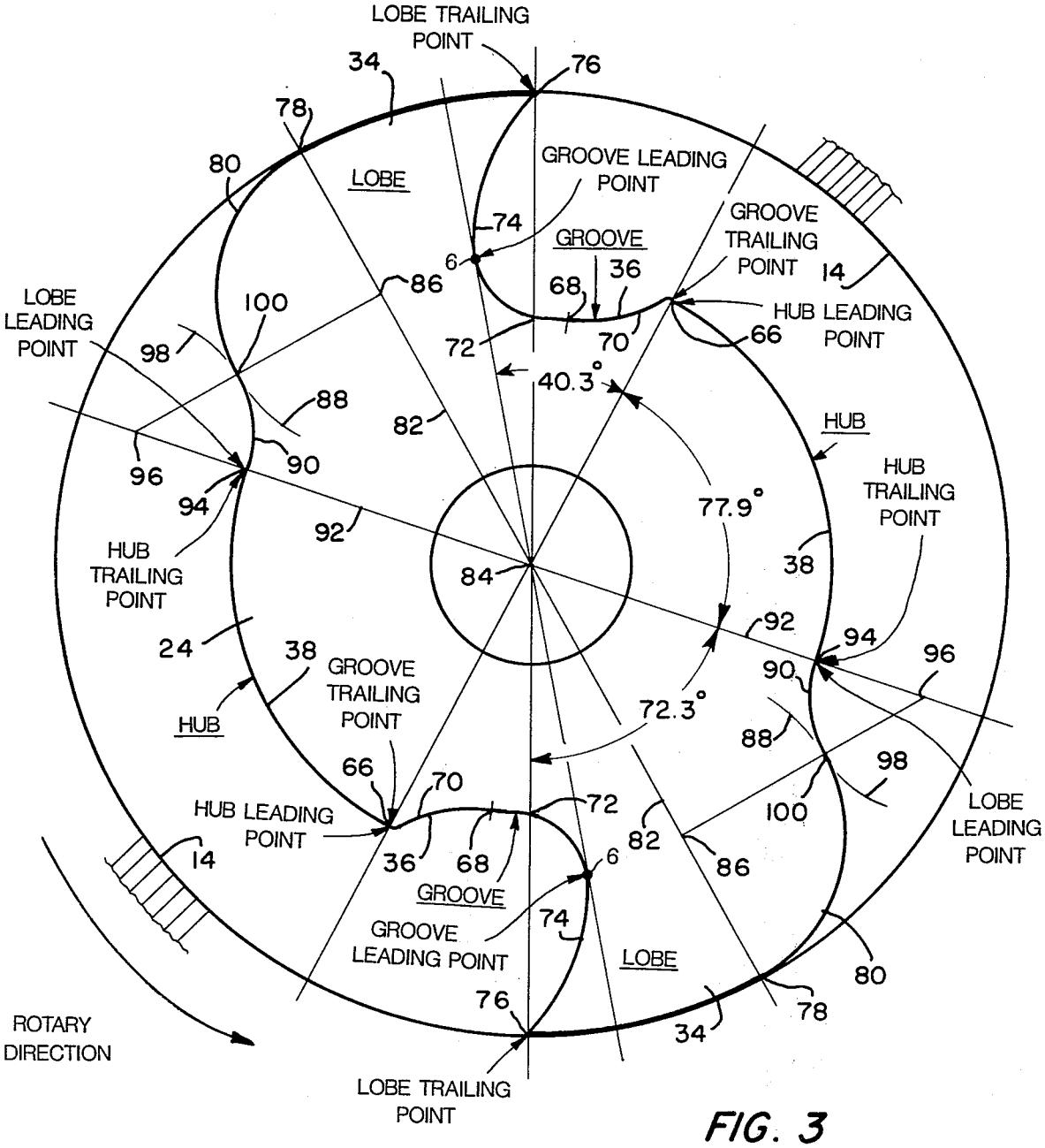
FIG. 3 is a line drawing of the co-acting main rotor of the first stage of FIG. 1.
Figure 4:
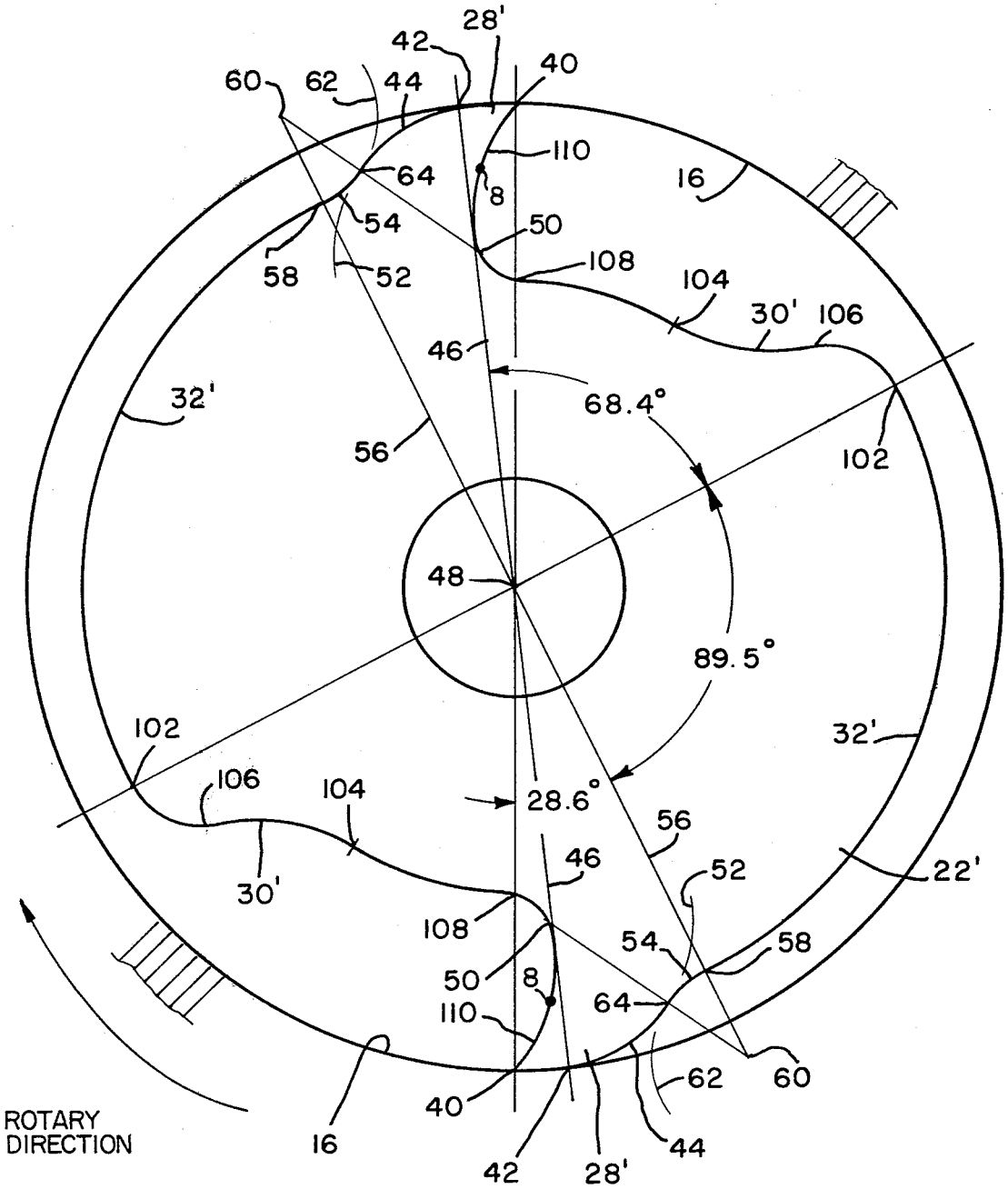
FIG. 4 is a line drawing of the gating rotor of the second stage of FIG. 1.
Figure 5:
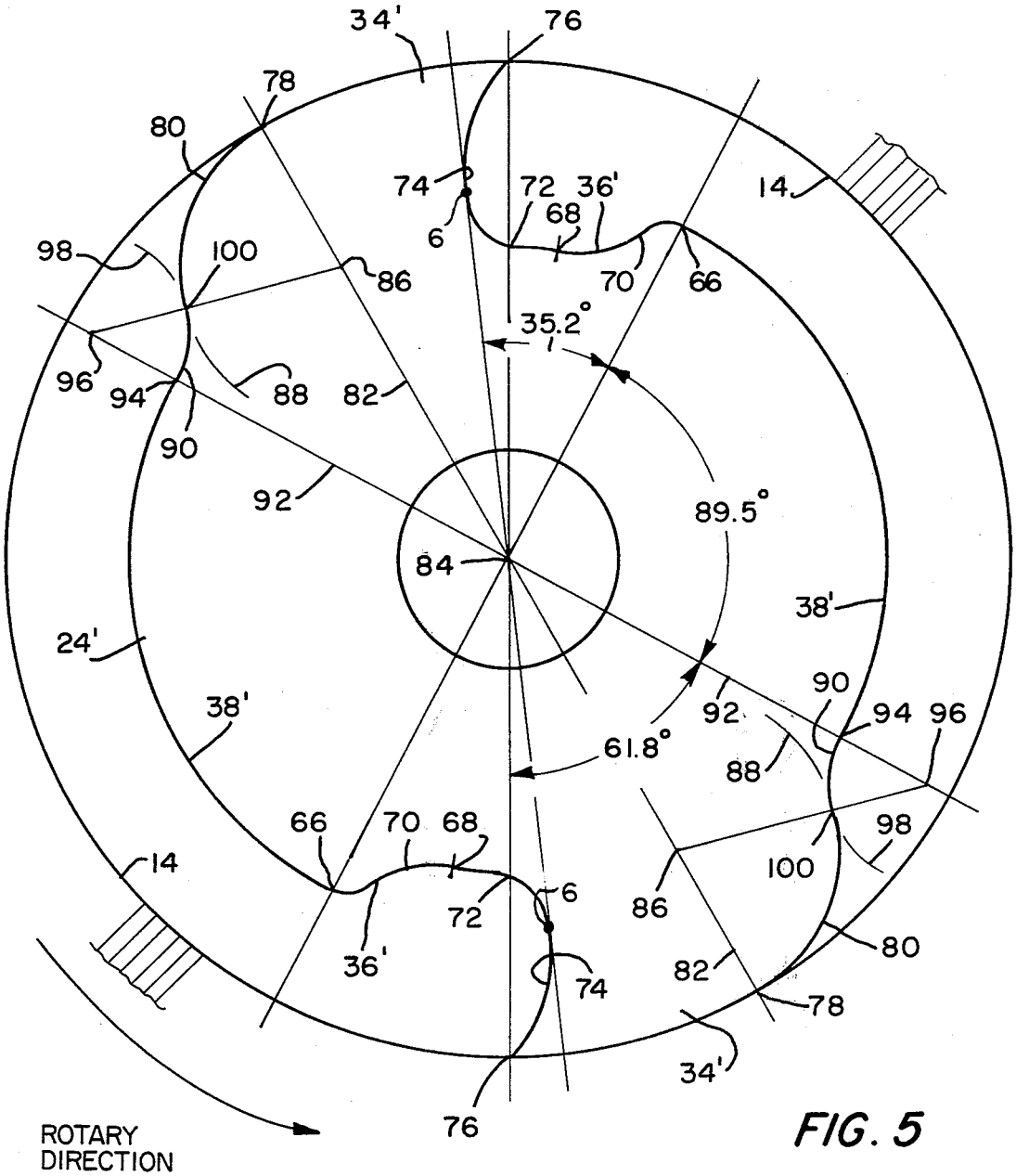
FIG. 5 is a line drawing of the co-acting main rotor of the second stage of FIG. 1.

For purposes of clarification, the hubs 32, lobes 28, and grooves 30, of rotor 22, are captioned in FIG. 2, along with the lobes', grooves', and hubs' leading and trailing points. It is to be understood that the same captions pertain as well to corresponding rotor portions and points on rotor 22' in FIG. 4. Similarly, the hubs 38, lobes 34, and grooves 36, and the leading and trailing points thereof, have been captioned in FIG. 3 on rotor 24. Again, it should be understood that these same, latter captions pertain as well to corresponding rotor portions and points on rotor 24' of FIG. 5. As captioned, the lobes 28 and 28' of rotors 22 and 22', respectively, have leading points 40 and trailing points 58. The hubs 32 and 32' thereof have leading points 58 and trailing points 102. The grooves 30 and 30' thereof have leading points 102 and trailing points 8. The lobes 34 and 34' of rotors 24 and 24', respectively, have leading points 94 and trailing points 76. The hubs 38 and 38' thereof have leading points 66 and trailing points 94. The grooves 36 and 36' thereof have trailing points 66 and leading points 6.

These very definitive configurations and relationships are critical to the optimum performance of the machine 10. Specific dimensions are not given; such will be determined by the desired c.f.m., tip speed and axial lengths of the rotors 22 and 24, etc. However, in any machine 10, defined according to my teachings herein, the dimensions should be such as to define a constant, uniform clearance between the rotors 22 and 24, and 22' and 24' in any rotary positioning thereof.

While I have described my invention in connection with specific embodiments thereof, it is to be clearly understood that this is done only by way of example, and not as a limitation to the scope of my invention as set forth in the objects thereof, and in the appended claims.

I claim:

1. A rotary, positive-displacement machine, with interengaging lobed-rotors having different-sized lobes, adapted to handle a fluid, comprising:

a housing;

said housing having a pair of parallel, cylindrical, intersecting bores, end walls for said bores, and first and second ports for the conduct therethrough of high-pressure and low-pressure fluid, respectively, wherein said first port is formed in one of said end walls;

first and second lobed-rotors rotatably mounted in said bores;

said first rotor has a hub which occludes said first port, and a groove which exposes said first port;

said hub has a radius of not more than ninety percent of the radius of the bore in which said first rotor is mounted;

said first rotor has a pair of grooves which, together, occupy less than one-half the circumference of said first rotor;

said first rotor has a pair of lobes which, together, occupy not more than approximately one-sixth the circumference of said first rotor;

said first rotor has an axial center;

each lobe of said pair thereof has, relative to a given rotary direction, an outermost leading tip and a first, intermediate reference point;

each lobe further has a flank defined by convex and concave surfaces;

said convex and concave surfaces describe first and second arcs, respectively; and said first arc is drawn from a second reference point which is traversed by a line extending between said axial center and said first reference point.

2. A rotary, positive-displacement machine, according to claim 1, wherein:

said hub radius is not less than eighty-five percent of the bore radius in which said first rotor is mounted.

3. A rotary, positive-displacement machine, according to claim 1, wherein:

said hub occupies less than one-half the circumference of said first rotor.

4. A rotary, positive-displacement machine, according to claim 1, wherein:

said second rotor has a hub having a radius of not more than sixty-five percent of the radius of the bore in which said second rotor is mounted.

5. A rotary, positive-displacement machine, according to claim 1, wherein:

said second rotor has a hub having a radius of not less than sixty percent of the radius of the bore in which said second rotor is mounted.

6. A rotary, positive-displacement machine, according to claim 1, wherein:

said second rotor has a pair of lobes which, together, occupy not less than approximately forty percent of the circumference of said second rotor.

7. A rotary, positive-displacement machine, according to claim 1, wherein:

said second rotor has a pair of grooves which, together, occupy not more than approximately twenty-two percent of the circumference of said second rotor.

8. A rotary, positive-displacement machine, according to claim 1, wherein:

said concave surface joins and is contiguous with a leading point of said hub of said first rotor;

said first and second arcs have a point of common tangency; and said second arc is drawn from a third reference point which is commonly traversed by (a) a line extending from said second reference point and through said point of tangency, and (b) a line extending from said axial center and through said leading point of said hub.

9. A rotary, positive-displacement machine, according to claim 1, wherein:

each one of said grooves is adjacent to a given one of said lobes;

each groove has a convex surface having leading and trailing points; and a line drawn between said leading tip of the thereadjacent lobe and said axial center traverses said trailing point of said groove convex surface.

10. A rotary, positive-displacement machine, according to claim 1, wherein:

said second rotor has a hub having a radius of not more than eighty percent of radius of the bore in which said second rotor is mounted.

11. A rotary, positive-displacement machine, according to claim 1, wherein:

said second rotor has a hub having a radius of not less than seventy-five percent of the radius of the bore in which said second rotor is mounted.

12. A rotary, positive-displacement machine, according to claim 1, wherein:

said second rotor has a pair of lobes which, together, occupy not less than thirty-four percent of the circumference of said second rotor.

13. A rotary, positive-displacement machine, according to claim 1, wherein:

said second rotor has a pair of grooves which, together, occupy not more than approximately nineteen and a half percent of the circumference of said second rotor.

14. For use in a rotary, positive-displacement machine adapted to handle a fluid, and having a housing which has a pair of parallel, cylindrical, intersecting bores, end walls for said bores, and first and second ports for the conduct therethrough of high-pressure and low-pressure fluid, respectively, wherein said first port is formed in one of said end walls;

a first rotor, for rotatable mounting thereof in one of said bores for co-acting, interengagement thereof with a second rotor rotatably mounted in the other of said bores, said first rotor having a hub for occluding said first port, and a groove for exposing said first port; and wherein said hub has a radius of not more than ninety percent of the radius of said one bore;

said first rotor has a pair of grooves which, together, occupy less than one-half the circumference of said first rotor;

said first rotor has a pair of lobes which, together, occupy not more than approximately one-sixth the circumference of said first rotor;

said first rotor further has an axial center;

each lobe of said pair thereof has, relative to a given rotary direction or rotatable mounting of said first rotor, an outermost leading tip and a first intermediate reference point;

each lobe further has a flank defined by convex and concave surfaces;

said convex and concave surfaces describe first and second arcs, respectively; and said first arc is drawn from a second reference point which is traversed by a line extending between said axial center and said first reference point.

15. A first rotor, for use in a positive-displacement machine, according to claim 14, wherein:

said hub radius is not less than eighty-five percent of said radius of said one bore.

16. A first rotor, for use in a positive-displacement machine, according to claim 14, wherein:

said hub occupies less than one-half the circumference of said first rotor.

17. A first rotor, for use in a positive-displacement machine, according to claim 14, wherein:

said concave surface joins and is contiguous with a leading point of said hub of said first rotor;

said first and second arcs have a point of common tangency; and said second arc is drawn from a third reference point which is commonly traversed by (a) a line extending from said second reference point and through said point of tangency, and (b) a line extending from said axial center and through said leading point of said hub.

18. A first rotor, for use in a positive-displacement machine, according to claim 14, wherein:

each one of said grooves is adjacent to a given one of said lobes;

each groove has a convex surface having leading and trailing points; and a line drawn between said leading tip of the thereadjacent lobe and said axial center traverses said trailing point of said groove convex surface.

19. For use in a rotary, postive-displacement machine adapted to handle a fluid, and having a housing which has a pair of parallel, cylindrical, intersecting bores, end walls for said bores, and first and second ports for the conduct therethrough of high-pressure and low-pressure fluid, respectively, wherein said first port is formed in one of said end walls;

a main rotor, for rotatable mounting thereof in one of said bores for co-acting, interengagement thereof with a gating rotor rotatably mounted in the other of said bores for occluding and exposing said first port, wherein said main rotor has a hub having a radius of not more than sixty-five percent of the radius of said one bore;

said main rotor has a pair of grooves which, together, occupy less than one-quarter the circumference of said main rotor;

said main rotor has a pair of lobes which, together, occupy not less than approximately forty percent the circumference of said main rotor;

said main rotor further has an axial center;

each lobe of said pair thereof has, relative to a given rotary direction of rotatable mounting of said main rotor, an outermost trailing tip and a first intermediate reference point;

each lobe further has a flank defined by convex and concave surfaces;

said convex and concave surfaces describe first and second arcs, respectively; and said first arc is drawn from a second reference point which is traversed by a line extending between said axial center and said first reference point.

20. A main rotor, for use in a positive-displacement machine, according to claim 19, wherein:

said hub radius is not less than sixty percent of said radius of said one bore.

21. A main rotor, for use in a positive-displacement machine, according to claim 19, wherein:

said hub occupies less than one-half the circumference of said main rotor.

22. A main rotor, for use in a positive-displacement machine, according to claim 19, wherein:

said concave surface joins and is contiguous with a trailing point of said hub of said main rotor;

said first and second arcs have a point of common tangency; and said second arc is drawn from a third reference point which is commonly traversed by (a) a line extending from said second reference point and through said point of tangency, and (b) a line extending from said axial center and through said trailing point of said hub.

23. A main rotor, for use in a positive-displacement machine, according to claim 19, wherein:

each one of said grooves is adjacent to a given one of said lobes;

each groove has a convex surface having leading and trailing points; and a line drawn between said trailing tip of the thereadjacent lobe and said axial center traverses said leading point of said groove convex surface.

24. For use in a rotary, postive-displacement machine adapted to handle a fluid, and having a housing which has a pair of parallel, cylindrical, intersecting bores, end walls for said bores, and first and second ports for the conduct therethrough of high-pressure and low-pressure fluid, respectively, wherein said first port is formed in one of said end walls;

a main rotor, for rotatable mounting thereof in one of said bores for co-acting, interengagement thereof with a gating rotor rotatably mounted in the other of said bores for occluding and exposing said first port, wherein said main rotor has a hub having a radius of not more than eighty percent of the radius of said one bore;

said main rotor has a pair of grooves which, together, occupy less than one-fifth the circumference of said main rotor;

said main rotor has a pair of lobes which, together, occupy not less than approximately thirty-four percent of the circumference of said main rotor;

said main rotor further has an axial center;

each lobe of said pair thereof has, relative to a given rotary direction of rotatable mounting of said main rotor, an outermost trailing tip and a first reference point;

each lobe further has a flank defined by convex and concave surfaces;

said convex and concave surfaces describe first and second arcs, respectively; and said first arc is drawn from a second reference point which is traversed by a line extending between said axial center and said first reference point.

25. A main rotor, for use in a positive-displacement machine, according to claim 24, wherein:

said hub radius is not less than seventy-five percent of said radius of said one bore.

26. A main rotor, for use in a positive-displacement machine, according to claim 24, wherein:

said hub occupies approximately one-half the circumference of said main rotor.

27. A main rotor, for use in a positive-displacement machine, according to claim 24, wherein:

said concave surface joins and is contiguous with a trailing point of said hub of said main rotor;

said first and second arcs have a point of common tangency; and said second arc is drawn from a third reference point which is commonly traversed by (a) a line extending from said second reference point and through said point of tangency, and (b) a line extending from said axial center and through said trailing point of said hub.

28. A main rotor, for use in a positive-displacement machine, according to claim 24, wherein:

each one of said grooves is adjacent to a given one of said lobes;

each groove has a convex surface having leading and trailing points; and a line drawn between said trailing tip of the thereadjacent lobe and said axial center traverses said leading point of said groove convex surface.

* * * * *